US007650277B2

(12) United States Patent
Prakash et al.

(10) Patent No.: US 7,650,277 B2
(45) Date of Patent: Jan. 19, 2010

(54) SYSTEM, METHOD, AND APPARATUS FOR FAST QUANTIZATION IN PERCEPTUAL AUDIO CODERS

(75) Inventors: Vinod Prakash, Bangalore (IN); Ashok I Magadum, Bangalore (IN)

(73) Assignee: Ittiam Systems (P) Ltd., Bangalore, Karnataka (IN)

( * ) Notice: Subject to any disclaimer, the term of this patent is extended or adjusted under 35 U.S.C. 154(b) by 687 days.

(21) Appl. No.: 10/671,324

(22) Filed: Sep. 25, 2003

(65) Prior Publication Data

US 2004/0158456 A1 Aug. 12, 2004

(30) Foreign Application Priority Data

Jan. 23, 2003 (IN) ..... 64/MAS/2003

(51) Int. Cl.
*G10L 19/00* (2006.01)

(52) U.S. Cl. ..... 704/200.1; 704/500; 704/501

(58) Field of Classification Search ..... 704/200, 704/200.1, 216–218, 226, 227, 229, 500, 704/501
See application file for complete search history.

(56) References Cited

U.S. PATENT DOCUMENTS

| | | | | |
|---|---|---|---|---|
| 4,790,015 | A * | 12/1988 | Callens et al. | 704/212 |
| 5,625,743 | A * | 4/1997 | Fiocca | 704/205 |
| 5,634,082 | A * | 5/1997 | Shimoyoshi et al. | 704/200.1 |
| 5,732,391 | A * | 3/1998 | Fiocca | 704/229 |
| 5,754,127 | A * | 5/1998 | Tsutsui et al. | 341/54 |
| 5,825,310 | A * | 10/1998 | Tsutsui | 341/51 |
| 6,169,973 | B1 * | 1/2001 | Tsutsui et al. | 704/500 |
| 6,246,345 | B1 * | 6/2001 | Davidson et al. | 341/51 |
| 6,604,069 | B1 * | 8/2003 | Tsutsui | 704/200.1 |
| 6,745,162 | B1 * | 6/2004 | Hu | 704/200.1 |
| 6,754,618 | B1 * | 6/2004 | Konstantinides et al. | 704/200.1 |
| 6,950,794 | B1 * | 9/2005 | Subramaniam et al. | 704/200.1 |
| 7,003,449 | B1 * | 2/2006 | Absar et al. | 704/200.1 |
| 7,016,502 | B2 * | 3/2006 | Toyama et al. | 381/23 |
| RE39,080 | E * | 4/2006 | Johnston | 704/200.01 |
| 7,110,953 | B1 * | 9/2006 | Edler et al. | 704/200.1 |
| 2002/0004718 | A1 * | 1/2002 | Hasegawa et al. | 704/229 |
| 2002/0152085 | A1 * | 10/2002 | Tsushima et al. | 704/500 |
| 2004/0267542 | A1 * | 12/2004 | Absar et al. | 704/500 |

* cited by examiner

*Primary Examiner*—Richemond Dorvil
*Assistant Examiner*—Douglas C Godbold
(74) *Attorney, Agent, or Firm*—Prakash Nama; Global IP services, PLLC

(57) ABSTRACT

A technique to encode an audio signal based on a perceptual model. In one example embodiment, this is accomplished by shaping quantization noise in the spectral lines on a band-by-band basis using their local gains. The noise shaped spectral lines are then fitted within a predetermined bit rate to form an encoded bit stream.

22 Claims, 3 Drawing Sheets

SYSTEM, METHOD, AND APPARATUS FOR FAST QUANTIZATION IN PERCEPTUAL AUDIO CODERS

This application claims priority under 35 U.S.C. 119 to Indian Provisional Application No. 64/MAS/2003 filed on Jan. 23, 2003 which is incorporated herein by reference.

TECHNICAL FIELD OF THE INVENTION

The present invention relates generally to perceptual audio coding techniques and more particularly to quantization schemes employed in transform based perceptual audio coders.

BACKGROUND OF THE INVENTION

In the present state of the art audio coders for use in coding signals representative of, for example, speech and music, for purposes of storage or transmission, perceptual models based on the characteristics of the human auditory system are typically employed to reduce the number of bits required to code a given signal. In particular, by taking such characteristics into account, "transparent" coding (i.e., coding having no perceptible loss of quality) can be achieved with significantly fewer bits than would otherwise be necessary. The coding process in perceptual audio coders is compute intensive and generally requires processors with high computation power to perform real-time coding. The quantization module of the encoder takes up significant part of the encoding time.

In such coders the signal to be coded is first partitioned into individual frames with each frame comprising a small time slice of the signal, such as, for example, a time slice of approximately twenty milliseconds. Then, the signal for the given frame is transformed into the frequency domain, typically with use of a filter bank. The resulting spectral lines may then be quantized and coded.

In particular, the quantizer which is used in a perceptual audio coder to quantize the spectral coefficients is advantageously controlled by a psychoacoustic model (i.e., a model based on the performance of the human auditory system) to determine masking thresholds (distortionless thresholds) for groups of neighboring spectral lines referred to as one scale factor band. The psychoacoustic model gives a set of thresholds that indicate the levels of Just Noticeable Distortion (JND), if the quantization noise introduced by the coder is above this level then it is audible. As long as the Signal to (quantization) Noise Ratio (SNR) of the spectral bands are higher than the Signal to Mask Ratio (SMR) the quantization noise cannot be perceived. The spectral lines in these scale factor bands are then non-uniformly quantized and noiselessly coded (Huffman coding) to produce a compressed bit stream.

In MPEG (Moving Picture Experts Group) Audio coders (MP3 or AAC) a major portion of the processing time is spent in the quantization module as the process is carried out iteratively. MP3 refers to MPEG-1 and MPEG-2 Layer 3 Audio Coding. AAC refers to MPEG-2/4 Advanced Audio Coding. The Quantizer uses different values of step sizes for different scale factor bands depending on the distortion thresholds set by a psychoacoustic block.

In one conventional method, quantization is carried out in two loops in order to satisfy perceptual and bit rate criteria. Prior to quantization the incoming spectral lines are raised to a power of 3/4 (Power law Quantizer) so as to provide a more consistent SNR over the range of quantizer values. The two loops, to satisfy the perceptual and the bit rate criteria, are run over the spectral lines. The two loops consist of an outer loop (distortion measure loop) and an inner loop (bit rate loop). In the inner loop, the quantization step size is adjusted in order to fit the spectral lines within a given bit rate. The above iterative process involves modifying the step size (referred to as the global gain, as it is common for the spectrum) until the spectral lines fit into a specified number of bits. The outer loop then checks for the distortion caused in the spectral lines on a band-by-band basis, and increases quantization precision for bands that have distortion above JND. The quantization precision is raised through step sizes referred to as local gains. The above iterative process repeats itself until both the bit rate and the distortion conditions are met. The global gain k and the set of local gain for each band r are sent to the decoder along with the quantized spectral lines.

One significant disadvantage with the above quantization scheme is its complexity. The implementation of the above quantization scheme involves the above two iterative loops. Each of the two iterative loops involves quantization, noiseless coding, and inverse-quantization to find a best possible match. The codebook search mechanism involving noiseless coding and the complex mathematical operations involving quantization and dequantization stages make this a computationally intensive block. Therefore, a significant portion of the processing time in the above encoding scheme is spent in the quantization modules. One conventional system for quantizing the frequency domain coefficients essentially includes an optimized variant of the above two iterative loops scheme.

The two iterative loops described-above terminate when all bands have distortion levels below a threshold estimated by the psychoacoustic model. Such conditions typically occur at higher bit rates (over 96 kbps/channel). Using the above approach at medium to low bit rates can lead to many outer loop iterations before it can reach (one of many) set exit conditions.

The problem becomes even more severe at lower bit rates when it is not possible to maintain the quality (SNR above SMR).The two loops can run many times before ending at some compromised quality depending on implementation specific exit conditions. These numerous iterations can significantly increase processing time. Therefore, the above conventional quantization technique is highly complex and computationally intensive and can require processors with high computation power to perform real-time encoding. In addition, the above conventional quantization technique can take up significant part of an encoder's time.

SUMMARY OF THE INVENTION

The present invention provides a single-loop quantization technique to generate a compressed audio signal based on a perceptual model. In one example embodiment, this is accomplished by shaping quantization noise in the spectral lines on a band-by-band basis by setting a scale factor in each band based on psychoacoustic parameters and energy ratio. The shaped spectral lines are then fitted within a given bit rate by running an inner loop to form an encoded bit stream.

DETAILED DESCRIPTION OF THE INVENTION

The present subject matter provides a fast method for quantizing frequency domain coefficients in transform based perceptual audio encoders. This method is especially suitable for MPEG-compliant audio encoding. In one example embodiment, a single loop quantization scheme for sub band coding of audio signal is proposed wherein band-by-scale band factors are set according to psychoacoustic and energy ratio criteria.

In the following detailed description of the embodiments of the invention, reference is made to the accompanying drawings that form a part hereof, and in which are shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limiting sense, and the scope of the present invention is defined only by the appended claims.

Figure 1:
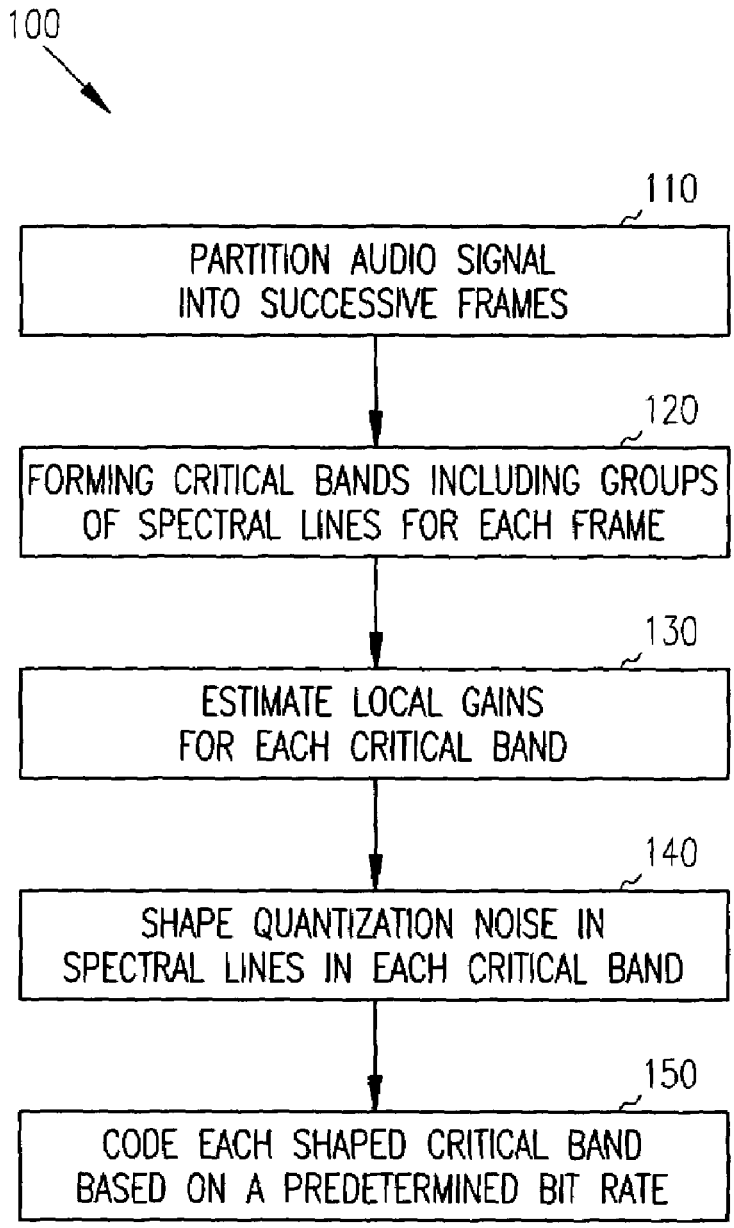
FIG. 1 is a flowchart illustrating a single-loop quantization technique.

The terms "coder" and "encoder" are used interchangeably throughout the document. In addition, the terms "bands", "critical bands", and "scale factor bands" are used interchangeably throughout the document FIG. 1 is a flowchart illustrating an embodiment of a method 100 of a single-loop quantization technique according to the present subject matter. At 110, the method 100 in this example embodiment partitions an audio signal into successive frames.

At 120, each frame is transformed into frequency domain and critical bands are formed by grouping neighboring spectral lines based on critical bands of hearing. At 130, local gain of each critical band is estimated. In some embodiments, the local gains of critical bands are estimated using the following equation:

$$K_b=-(int)(\alpha*\log 2(en(b)/\text{sum_en})+\beta*\log 2\ (\text{SMR}(b)))$$

wherein $K_b$ is the local gain for each band, log 2 is logarithm to base 2, en(b) is the band energy in band b, sum_en is total energy in a frame, SMR (b) is the psychoacoustic threshold for band b, wherein $\alpha$ measures weightage due to energy ratio, and $\beta$ is a weightage due to SMRs.

At 140, the spectral lines in each critical band are shaped using the estimated local gain. In some embodiments, the local gain of each critical band is estimated such that the difference between Signal-to-Mask Ratio (SMR) and Signal-to-Noise Ratio (SNR) is substantially constant in each critical band. In these embodiments, a higher quantization precision is assigned to critical bands having a higher SMR and further a quantization precision is assigned to each critical band such that it is inversely in proportion to their energy content with respect to frame energy to desensitize each critical band. At 150, each shaped critical band is coded using a predetermined bit rate.

Although the method 100 includes blocks 110-150 that are arranged serially in the exemplary embodiments, other embodiments of the present subject matter may execute two or more blocks in parallel, using multiple processors or a single processor organized as two or more virtual machines or sub-processors. Moreover, still other embodiments may implement the blocks as two or more specific interconnected hardware modules with related control and data signals communicated between and through the modules, or as portions of an application-specific integrated circuit. Thus, the exemplary process flow diagrams are applicable to software, firmware, and/or hardware implementations.

Figure 2:
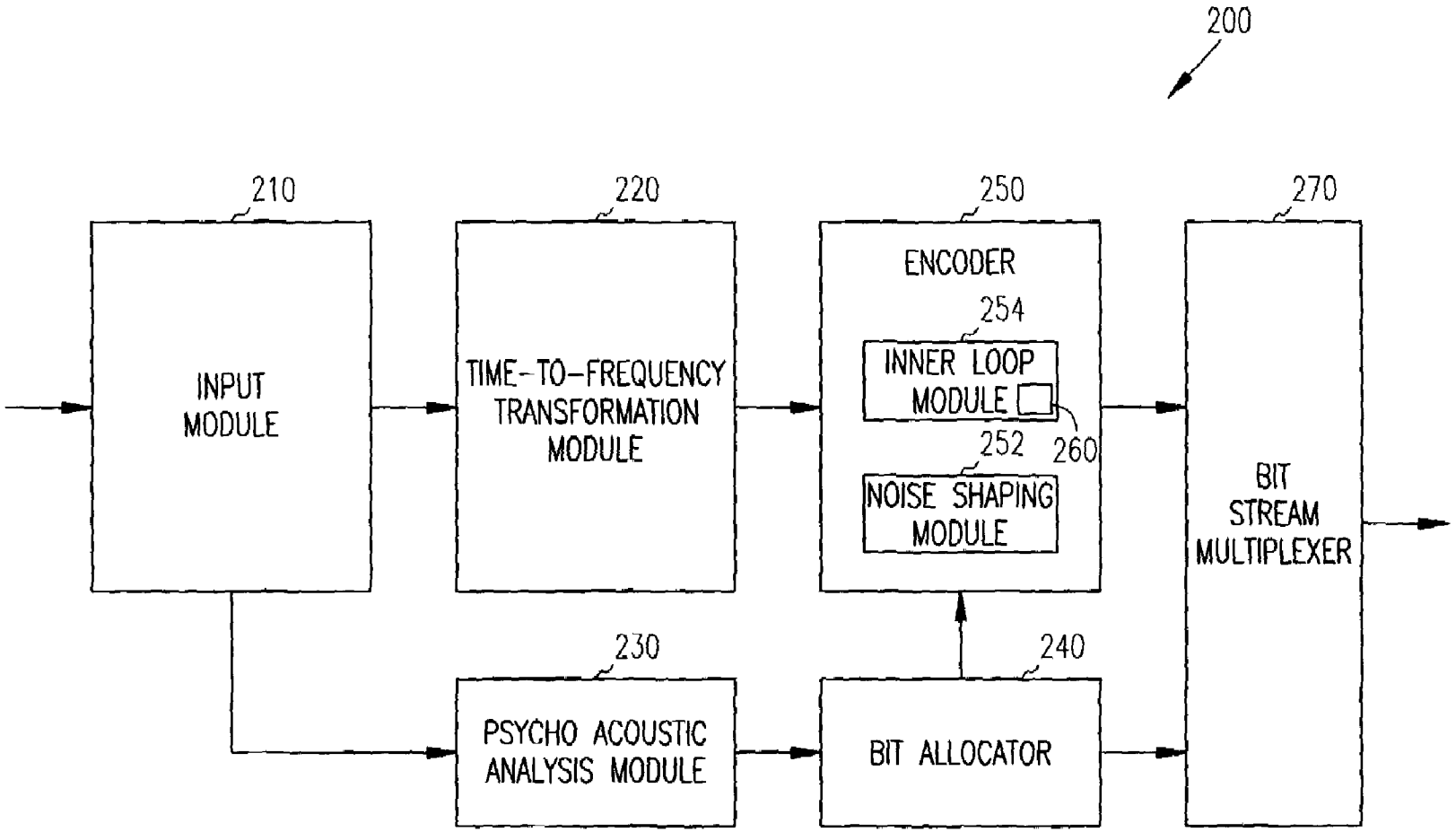
FIG. 2 is a block diagram illustrating an example perceptual audio coder.

Referring now to FIG. 2, there is illustrated an example embodiment of an audio encoder 200 according to the present subject matter. The audio encoder 200 includes an input module 210, a time-to-frequency transformation module 220, a psychoacoustic analysis module 230, and a bit allocator 240. The audio encoder 200 further includes an encoder 250 coupled to the time-to-frequency transformation module 220 and the psycho acoustic analysis module 230. As shown in FIG. 2, the encoder 250 includes a noise shaping module 252 and an inner loop module 254. The inner loop module 254 includes an entropy coding module 260. Further the audio encoder 200 shown in FIG. 2, includes a bit stream multiplexer 270 coupled to both the encoder 250 and the bit allocator 240.

In operation, in one example embodiment, the input module 210 receives an audio signal representative of, for example, speech and music, for purposes of storage or transmission. Perceptual models are based on characteristics of the human auditory system typically employed to reduce the number of bits required to code a given signal. In particular, by taking such characteristics into account, "transparent" coding (i.e., coding having no perceptible loss of quality) can be achieved with significantly fewer bits than would otherwise be necessary. The input module 210 in such cases partitions the received audio signal into individual frames, with each frame comprising a small time slice of the signal, such as, for example, a time slice of approximately twenty milliseconds.

The time-to-frequency transformation module 220 then receives each frame and transforms into the frequency domain, typically with the use of a filter bank, including spectral lines/coefficients. Further, the time-to-frequency module 220 forms critical bands by grouping neighboring spectral lines, based on critical bands of hearing, within each frame.

The psychoacoustic module 230 then receives the audio signal from the input module 210 and determines the effects of the psychoacoustic model. The bit allocator 240 then estimates the bit demand based (i.e., the number of bits requested by the encoder 250 to code a given frame) based on the determined psychoacoustic model. The bit demand typically varies, having a large range, from frame to frame. The bit allocator 240 then allocates number of bits that can be given to the encoder 250 based on a predetermined bit rate to code the frame.

The noise shaping module 252 then receives the spectral lines in each critical band and shapes quantization noise of the spectral lines in each critical band by using its local gain. In one example embodiment, the noise shaping module 252 estimates the local gain of each critical band using the equation:

$$K_b=-(int)(\alpha*\log 2(en(b)/\text{sum_en})+\beta*\log 2\ (\text{SMR}(b)))$$

wherein $K_b$ is the local gain for each band, log 2 is logarithm to base 2, en(b) is the band energy in band b, sum_en is total energy in a frame, SMR (b) is the psychoacoustic threshold for band b, wherein $\alpha$ measures weightage due to energy ratio, and $\beta$ is a weightage due to SMRs.

In some embodiments, the noise shaping module estimates 252 the local gain of each critical band such that the difference between Signal-to-Mask Ratio (SMR) and Signal-to-Noise Ratio (SNR) is substantially constant in each critical band. In these embodiments, the noise shaping module 252 assigns a higher precision to critical bands having a higher SMR and further assigns a quantization precision to each critical band inversely in proportion to their energy content with respect to frame energy to desensitize each critical band.

The encoder 250 then codes each critical band by running an inner loop to find a common scale factor for spectral lines in the critical bands such that they fit within a predetermined bit rate. In these embodiments, the encoder 250 runs the inner loop based on the estimated bit demand and the predetermined bit rate to code the audio signal. The entropy coding module 260 then removes statistical redundancies from the coded audio signal. This coded audio signal is then packaged by the bit stream multiplexer 270 to output a final encoded bit stream.

The various embodiments of the audio encoder, systems, and methods described herein are applicable generically to encoding an audio signal to produce a compressed bit stream. The technique described-above reduces complexity by eliminating the outer loop to quantize the audio signal. The above technique reduces the complexity of the encoder, while maintaining the similar quality of the conventional encoding scheme. The above-described technique also reduces complexity of MPEG Layer 3 and Advance Audio Coding by about 20% to 50%.

The following table illustrates the quality of the encoded signal using the above-described techniques based on measuring the Mean Opinion Score (MOS) of few audio files from Sound Quality Assessment Material (SQAM) using the Perceptual Audio Quality Evaluation tool (based on ITU-R BS. 1387).

| SQAM | | MOS ratings for MP3 Encoder using Conventional Quantization Scheme | | | MOS ratings for MP3 Encoder using the Quantization Scheme described in the present subject matter | | |
|---|---|---|---|---|---|---|---|
| Audio Clip | Description | 64 Kbps | 96 Kbps | 128 Kbps | 64 Kbps | 96 Kbps | 128 Kbps |
| Frer07_1 | Music, 44.1 KHz | 4.91 | 5 | 5 | 5 | 5 | 5 |
| Spme50_1 | Male speech, 44.1 KHz | 2.64 | 4.1 | 4.7 | 2.02 | 3.68 | 4.58 |
| Trpt21_2 | Air instrument, 44.1 KHz | 2.77 | 3.65 | 4.51 | 2.82 | 3.58 | 4.31 |

It can be seen from the above table that the measured MOS scores of the audio clips quantized using the techniques described in the present subject matter are substantially similar to the audio signals quantized using the conventional scheme.

In addition, the following table highlights the performance benefits of the present subject matter as compared to the existing techniques. The following speed up factors shown in the table are complexity reduction numbers measured by taking the number of times the outer loop is executed using the conventional scheme in an MP3 encoder:

| SQAM Audio | | Speed up factor for the total Encoder using New Quantization Scheme | | | Speed up factor for the new quantization scheme compared to conventional quantization scheme. | | |
|---|---|---|---|---|---|---|---|
| Clip | Description | 64 Kbps | 96 Kbps | 128 Kbps | 64 Kbps | 96 Kbps | 128 Kbps |
| Frer07_1 | Music, 44.1 KHz | 2.11 | 1.49 | 1.62 | 4.71 | 3.57 | 2.81 |
| Spme50_1 | Male speech, 44.1 KHz | 3.28 | 2.56 | 2.08 | 7.16 | 4.92 | 3.61 |
| Trpt21_2 | Air instrument, 44.1 KHz | 2.89 | 2.47 | 1.89 | 6.04 | 4.76 | 3.25 |

The speed up factors shown above are for stereo files. The above speed up factors were obtained using PC based floating-point encoder model. The speed up factors shown above is based on execution times required between the conventional quantization scheme and the quantization scheme described in the present subject matter. It can be seen from the above table that the execution times required to quantize the audio clips using the convention scheme are significantly higher than the execution times required to quantize the same audio clips using the techniques presented above in the present subject matter.

Further, the above-described encoder, system, and method facilitates real time encoding of audio data at low bit rates on processors/platforms that do not have significant processing power, such as mobile multimedia platforms. Furthermore, the above-described technique can be used in any application requiring real time encoding of audio signals using the dual-loop quantization technique.

Various embodiments of the present invention can be implemented in software, which may be run in the environment shown in FIG. 3 (to be described below) or in any other suitable computing environment. The embodiments of the present invention are operable in a number of general-purpose or special-purpose computing environments. Some computing environments include personal computers, general-purpose computers, server computers, hand-held devices (including, but not limited to, telephones and personal digital assistants of all types), laptop devices, multi-processors, microprocessors, set-top boxes, programmable consumer electronics, network computers, minicomputers, mainframe computers, distributed computing environments and the like to execute code stored on a computer-readable medium. The embodiments of the present invention may be implemented in part or in whole as machine-executable instructions, such as program modules that are executed by a computer. Generally, program modules include routines, programs, objects, components, data structures, and the like to perform particular tasks or to implement particular abstract data types. In a distributed computing environment, program modules may be located in local or remote storage devices.

Figure 3:
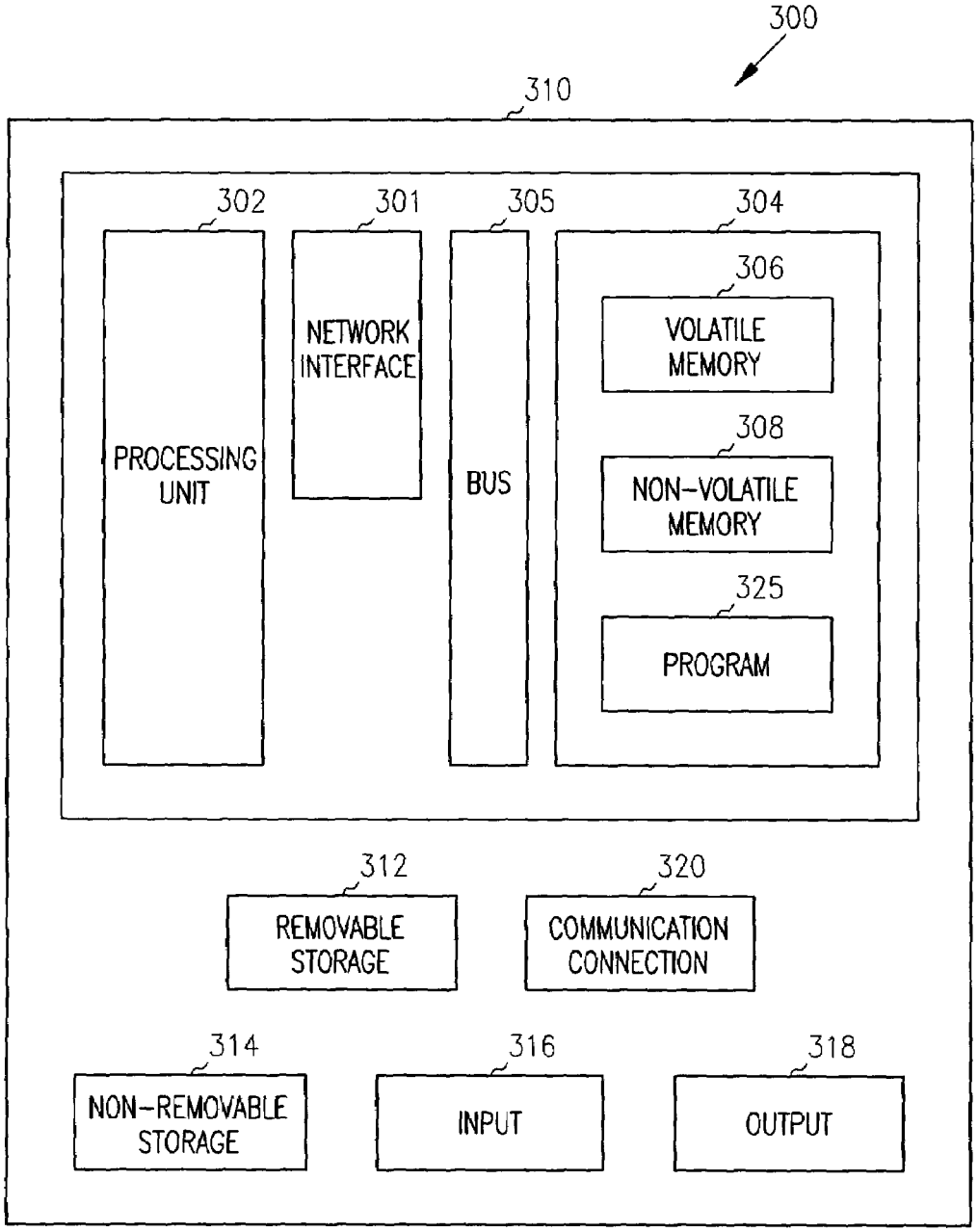
FIG. 3 is an example of a suitable computing environment for implementing embodiments of the present invention.

FIG. 3 shows an example of a suitable computing system environment for implementing embodiments of the present invention. FIG. 3 and the following discussion are intended to provide a brief, general description of a suitable computing environment in which certain embodiments of the inventive concepts contained herein may be implemented.

A general computing device, in the form of a computer 310, may include a processing unit 302, memory 304, removable storage 312, and non-removable storage 314. Computer 310 additionally includes a bus 305 and a network interface (NI) 301.

Computer 310 may include or have access to a computing environment that includes one or more input elements 316, one or more output elements 318, and one or more communication connections 320 such as a network interface card or a USB connection. The computer 310 may operate in a networked environment using the communication connection 320 to connect to one or more remote computers. A remote computer may include a personal computer, server, router, network PC, a peer device or other network node, and/or the like. The communication connection may include a Local Area Network (LAN), a Wide Area Network (WAN), and/or other networks.

The memory 304 may include volatile memory 306 and non-volatile memory 308. A variety of computer-readable media may be stored in and accessed from the memory elements of computer 310, such as volatile memory 306 and non-volatile memory 308, removable storage 312 and non-removable storage 314.

Computer memory elements can include any suitable memory device(s) for storing data and machine-readable instructions, such as read only memory (ROM), random access memory (RAM), erasable programmable read only memory (EPROM), electrically erasable programmable read only memory (EEPROM), hard drive, removable media drive for handling compact disks (CDs), digital video disks (DVDs), diskettes, magnetic tape cartridges, memory cards, Memory Sticks™, and the like; chemical storage; biological storage; and other types of data storage. "Processor" or "processing unit," as used herein, means any type of computational circuit, such as, but not limited to, a microprocessor, a microcontroller, a complex instruction set computing (CISC) microprocessor, a reduced instruction set computing (RISC) microprocessor, a very long instruction word (VLIW) microprocessor, explicitly parallel instruction computing (EPIC) microprocessor, a graphics processor, a digital signal processor, or any other type of processor or processing circuit. The term also includes embedded controllers, such as generic or programmable logic devices or arrays, application specific integrated circuits, single-chip computers, smart cards, and the like.

Embodiments of the present invention may be implemented in conjunction with program modules, including functions, procedures, data structures, application programs, etc., for performing tasks, or defining abstract data types or low-level hardware contexts.

Machine-readable instructions stored on any of the above-mentioned storage media are executable by the processing unit 302 of the computer 310. For example, a computer program 325 may comprise machine-readable instructions capable of shaping quantization noise in each band by setting a scale factor in each band based on its psychoacoustic parameters and energy ratio according to the teachings and herein described embodiments of the present invention. In one embodiment, the computer program 325 may be included on a CD-ROM and loaded from the CD-ROM to a hard drive in non-volatile memory 308. The machine-readable instructions cause the computer 310 to encode an audio signal on a band-by-band basis by shaping quantization noise in each band using its local gain according to some embodiments of the present invention.

The above description is intended to be illustrative, and not restrictive. Many other embodiments will be apparent to those skilled in the art. The scope of the invention should therefore be determined by the appended claims, along with the full scope of equivalents to which such claims are entitled.

The invention claimed is:

1. A method for real-time encoding of an audio signal in an audio encoder, comprising:

grouping spectral lines to form scale band factors by determining masking thresholds based on human perception system using a time-to-frequency transformation module of the audio encoder;

calculating local gain for each scale band factor using a quantizer coupled to a processor in the audio encoder;

shaping quantization noise in spectral lines in each scale band factor using its local gain using the quantizer, wherein the local gain of each scale band factor is estimated as a function of band energy ratios and SMRs, wherein the shaping the quantization noise in each scale band factor such that a difference between SMR and SNR in each scale band factor is substantially constant, wherein the energy ratios are computed by dividing energy in each band over sum of energies in all bands, and wherein the local gain in each scale band factor is derived using the equation:

$$K_b=-(int)(\alpha*\log 2(\mathrm{en}(b)/\mathrm{sum_en})+\beta*\log 2(\mathrm{SMR}(b)))$$

wherein $K_b$ is the local gain for each band, log 2 is logarithm to base 2, en(b) is the band energy in band b, sum_en is total energy in a frame, SMR(b) is the psychoacoustic threshold for band b, wherein $\alpha$ measures weightage due to energy ratio, and $\beta$ is a weightage due to SMRs; and running a loop for each scale band factor to satisfy a predetermined bit allocation rate based on a bit allocation scheme using an inner loop module of the audio encoder.

2. The method of claim 1, wherein shaping the quantization noise in each scale band factor such that the difference between SMR and SNR is substantially constant comprises:

assigning a higher quantization precision to scale band factors having a high SMR; and assigning quantization precision to each scale band factor that is inversely in proportion to their energy content with respect to frame energy to desensitize the scale factor bands.

3. A single-loop quantization method for band-by-band coding of an audio signal in an audio encoder, comprising:

calculating local gain for each band using a quantizer coupled to a processor in the audio encoder; and shaping quantization noise in each band using its local gain using the quantizer, wherein the local gain in each band is derived using the equation:

$$K_b=-(int)(\alpha*\log 2(\mathrm{en}(b)/\mathrm{sum_en})+\beta*\log 2(\mathrm{SMR}(b)))$$

wherein $K_b$ is the local gain for each band, log 2 is logarithm to base 2, en(b) is the band energy in band b, sum_en is total energy in a frame, SMR(b) is the psychoacoustic threshold for band b, wherein $\alpha$ measures weightage due to energy ratio, and $\beta$ is a weightage due to SMRs.

4. The method of claim 3, wherein shaping the quantization noise in each band using its local gain comprises:

shaping the quantization noise in each band by setting a scale factor in each band based on its psychoacoustic parameters and energy ratio.

5. The method of claim 3, wherein shaping quantization noise in each band using its local gain comprises:

shaping quantization noise in spectral lines in each band such that a difference between Signal-to-Mask Ratio (SMR) and Signal-to-Noise Ratio (SNR) in each band is substantially constant.

6. The method of claim 5, wherein the spectral lines are derived by performing a time to frequency transformation of the audio signal.

7. The method of claim 6, further comprising:

partitioning the audio signal into a sequence of successive frames;

forming bands including groups of neighboring spectral lines for each frame based on critical bands of hearing; and computing local gain for each band.

8. The method of claim 5, wherein shaping the quantization noise in each band such that the difference between SMR and SNR is substantially constant comprises:

assigning a higher quantization precision to bands having a higher SMR; and further assigning quantization precision to each band such that the assigned quantization precision is inversely in proportion to their energy content with respect to band energy to desensitize the bands.

9. A method for encoding an audio signal in an audio encoder, based on a perceptual model, comprising:

calculating local gain for each scale band factor using a quantizer coupled to a processor in the audio encoder; and quantization noise shaping of spectral lines on a band-by-band basis using the local gain using the quantizer, wherein the local gain of each band is estimated as a function of band energy ratios and SMRs such that a difference between SMR and SNR is held substantially constant for each band, wherein the energy ratios are computed by dividing energy in each band over sum of energies in all bands, and wherein the local gain in each scale band factor is derived using the equation:

$$K_b=-(int)(\alpha*\log 2(\mathrm{en}(b)/\mathrm{sum_en})+\beta*\log 2(\mathrm{SMR}(b)))$$

wherein $K_b$ is the local gain for each band, log 2 is logarithm to base 2, en(b) is the band energy in band b, sum_en is total energy in a frame, SMR(b) is the psychoacoustic threshold for band b, wherein α measures weightage due to energy ratio, and β is a weightage due to SMRs.

10. The method of claim 9, wherein the quantization noise shaping of each scale band factor such that the difference between SMR and SNR is substantially constant comprises:

assigning a higher quantization precision to bands having a high SMR; and assigning a quantization precision to each band that is inversely in proportion to their energy content with respect to band energy to desensitizing the bands.

11. The method of claim 10, wherein filling the noise shaped spectral lines comprises:

estimating a bit demand for each band; and allocating the estimated bit demand based on a predetermined bit rate.

12. An apparatus comprising an encoder including a quantizer coupled to a processor to quantize an audio signal based on a perceptual model comprising calculating local gain for each band and quantization noise shaping of spectral lines on a band by-band basis using the local gain, wherein the quantization noise shaping the spectral lines on the band-by-band basis such that the difference between SMR and SNR is substantially constant in each band, wherein the local gains are derived using the equation:

$$K_b=-(int)(\alpha*\log 2(\mathrm{en}(b)/\mathrm{sum_en})+\beta*\log 2(\mathrm{SMR}(b)))$$

wherein $K_b$ is the local gain for each scale band factor, log 2 is logarithm to base 2, en(b) is the band energy in scale band factor b, sum_en is the total energy in a frame, SMR(b) is the psychoacoustic threshold for scale band factor b, wherein α measure weightage due to energy ratio, and β is the weightage due to SMRs; and fitting spectral lines within each band based on a given bit rate.

13. The apparatus of claim 12, wherein the local gains are derived from energy ratios and SMRs in each band.

14. An apparatus for coding a signal based on a perceptual model, wherein the apparatus includes an audio encoder including a quantizer coupled to a processor, comprising:

means for calculating local gain for each scale band factor using the quantizer coupled to the processor in the audio encoder;

means for shaping quantization noise in spectral lines on a band-by-band basis using the local gain using the processor, wherein the local gain of each band is estimated as a function of band energy ratios and SMRs, wherein the means for shaping quantization noise in the spectral lines such that the difference between SMR and SNR is substantially constant for each band, wherein the energy ratios are computed by dividing energy in each band over sum of energies in all bands, and wherein the local gain in each scale band factor is derived using the equation:

$$K_b=-(int)(\alpha*\log 2(\mathrm{en}(b)/\mathrm{sum_en})+\beta*\log 2(\mathrm{SMR}(b)))$$

wherein $K_b$ is the local gain for each scale band factor, log 2 is logarithm to base 2, en(b) is the band energy in scale band factor b, sum en is the total energy in a frame, SMR(b) is the psychoacoustic threshold for scale band factor b, wherein α measure weightage due to energy ratio, and β is the weightage due to SMRs; and means for quantizing the shaped spectral lines in each band based on a predetermined bit rate.

15. The apparatus of claim 14, further comprising:

means for partitioning the signal into a sequence of successive frames;

means for performing time-to-frequency transformation to obtain the spectral lines in each frame; and means for forming bands by grouping neighboring spectral lines within each frame.

16. The apparatus of claim 14, wherein the means for quantizing of the spectral lines further comprises:

means for estimating bit demand in each band; and means for allocating bit based on a predetermined bit rates.

17. An audio encoder comprising a quantizer coupled to a processor to calculate local gain for each scale band factor and shape quantization noise in spectral lines in each band using the local gain, wherein the local gain of each band is estimated as a function of band energy ratios and SMRs and to further run a loop to fit the shaped spectral lines in each band within a predetermined bit rate, wherein the energy ratios are computed by dividing energy in each band over sum of energies in all bands, and wherein the local gain in each scale band factor is derived using the equation:

$$K_b=-(int)(\alpha*\log 2(en(b)/sum_en)+\beta*\log 2(SMR(b)))$$

wherein $K_b$ is the local gain for each scale band factor, log 2 is logarithm to base 2, en(b) is the band energy in scale band factor b, sum_en is the total energy in a frame, SMR(b) is the psychoacoustic threshold for scale band factor b, wherein α measure weightage due to energy ratio, and β is the weightage due to SMRs;

a noise shaping module to shape the quantization noise in each band such that a difference between SMR and SNR is held substantially constant in each band; and an inner loop module to fit shaped band within the predetermined bit rate.

18. The audio encoder of claim 17, further comprising:

an input module to partition an audio signal into a sequence of successive frames; and a time-to-frequency transformation module to obtain the spectral lines in each frame, wherein the time-to-frequency transformation module to form bands by grouping neighboring spectral lines with each frame.

19. An article comprising:

a storage medium having instructions that, when executed by a computing platform, result in execution of a method comprising:

calculating local gain for each scale band factor using a quantizer coupled to a processor in an audio encoder; and encoding an audio signal in the audio encoder, based on a perceptual model, by noise shaping spectral lines on a band-by-band basis using their local gains, wherein the local gain of each band is estimated as a function of band energy ratios and SMRs, such that the difference between SMR and SNR is held substantially constant for each band, wherein the energy ratios are computed by dividing energy in each band over sum of energies in all bands, and wherein the local gains are derived using the equation:

$$K_b=-(int)(\alpha*\log 2(en(b)/sum_en)+\beta*\log 2(SMR(b)))$$

wherein $K_b$ is the local gain for each scale band factor, log 2 is logarithm to base 2, en(b) is the band energy in scale band factor b, sum en is the total energy in a frame, SMR(b) is the psychoacoustic threshold for scale band factor b, wherein α measure weightage due to energy ratio, and β is the weightage due to SMRs.

20. The article of claim 19, wherein the local gains are derived from energy ratios and SMRs in each band.

21. A system comprising:

a bus;

a processor couples to the bus;

a memory coupled to the processor;

a network interface coupled to the processor and the memory;

an audio encoder comprising a quantizer coupled to the network interface and the processor to calculate local gain for each scale band factor and shape quantization noise in spectral lines in each band using the local gain, wherein the local gain of each scale band factor is estimated as a function of band energy ratios and SMRs and to further run a loop to fit the shaped spectral lines in each band within a predetermined bit rate, wherein the energy ratios are computed by dividing energy in each band over sum of energies in all bands, and wherein the local gain in each scale band factor is derived using the equation:

$$K_b=-(int)(\alpha*\log 2(en(b)/sum_en)+\beta*\log 2(SMR(b)))$$

wherein $K_b$ is the local gain for each scale band factor, log 2 is logarithm to base 2, en(b) is the band energy in scale band factor b, sum_en is the total energy in a frame, SMR(b) is the psychoacoustic threshold for scale band factor b, wherein α measure weightage due to energy ratio, and β is the weightage due to SMRs;

a noise shaping module to shape the quantization noise in each band such that a difference between SMR and SNR is held substantially constant in each band; and an inner loop module to fit shaped band within the pre-determined bit rate.

22. The system of claim 21, further comprising:

an input module to partition an audio signal into a sequence of successive frames; and a time-to-frequency transformation module to obtain the spectral lines in each frame, wherein the time-to-frequency transformation module to form bands by grouping neighboring spectral lines with each frame.

* * * * *